US011313121B2

(12) United States Patent
Quirijns et al.

(10) Patent No.: US 11,313,121 B2
(45) Date of Patent: Apr. 26, 2022

(54) DRY PARTITION WALL SYSTEM AND METHOD FOR INSTALLATION OF A DRY PARTITION WALL SYSTEM OF THIS KIND

(71) Applicant: Saint-Gobain Placo S.A.S., Suresnes (FR)

(72) Inventors: Catharinus Anne Quirijns, GK Sprang-Capelle (NL); Simon Scheepens, DB Amersfoort (NL)

(73) Assignee: Saint-Gobain Placo S.A.S.

( * ) Notice: Subject to any disclaimer, the term of this patent is extended or adjusted under 35 U.S.C. 154(b) by 0 days.

(21) Appl. No.: 16/636,117

(22) PCT Filed: Aug. 8, 2018

(86) PCT No.: PCT/EP2018/071366
§ 371 (c)(1),
(2) Date: Feb. 3, 2020

(87) PCT Pub. No.: WO2019/030217
PCT Pub. Date: Feb. 14, 2019

(65) Prior Publication Data

US 2020/0378114 A1 Dec. 3, 2020

(30) Foreign Application Priority Data

Aug. 8, 2017 (DE) ..... 102017118005.2

(51) Int. Cl.
*E04B 2/82* (2006.01)
*E04B 2/74* (2006.01)

(52) U.S. Cl.
CPC ..... *E04B 2/821* (2013.01); *E04B 2/7403* (2013.01); *E04B 2/828* (2013.01)

(58) Field of Classification Search
CPC .... E04B 1/6133; E04B 2/7403; E04B 2/7451; E04B 2/789; E04B 2/821; E04B 2/825; E04B 2/828
See application file for complete search history.

(56) References Cited

U.S. PATENT DOCUMENTS 1,998,688 A * 4/1935 Robinson ..... E04B 2/76 52/241
2,056,328 A * 10/1936 Price ..... E04B 2/7457 52/243

(Continued)

FOREIGN PATENT DOCUMENTS

DE 6931401 U 7/1940
DE 2519469 B1 10/1976

(Continued)

OTHER PUBLICATIONS

Notification of Transmittal of the International Search Report and the Written Opinion of the International Searching Authority, PCT Application No. PCT/EP2018/071366, dated Nov. 13, 2018, 15 pages.

(Continued)

*Primary Examiner* — James M Ference
(74) *Attorney, Agent, or Firm* — Christopher McKeon; Arnold & Saunders, LLP

(57) ABSTRACT

A dry partition wall system comprising a plurality of wall elements, a floor-side connection element extending over several wall elements, a ceiling-side connection element extending over several wall elements, in which the plurality of wall elements are arranged side by side and are retained on the floor-side connection element and on the ceiling side-connection element and thus jointly form a partition wall, and in which the wall elements are of a multi-layer design.

11 Claims, 5 Drawing Sheets

(56) References Cited

Figure 1:
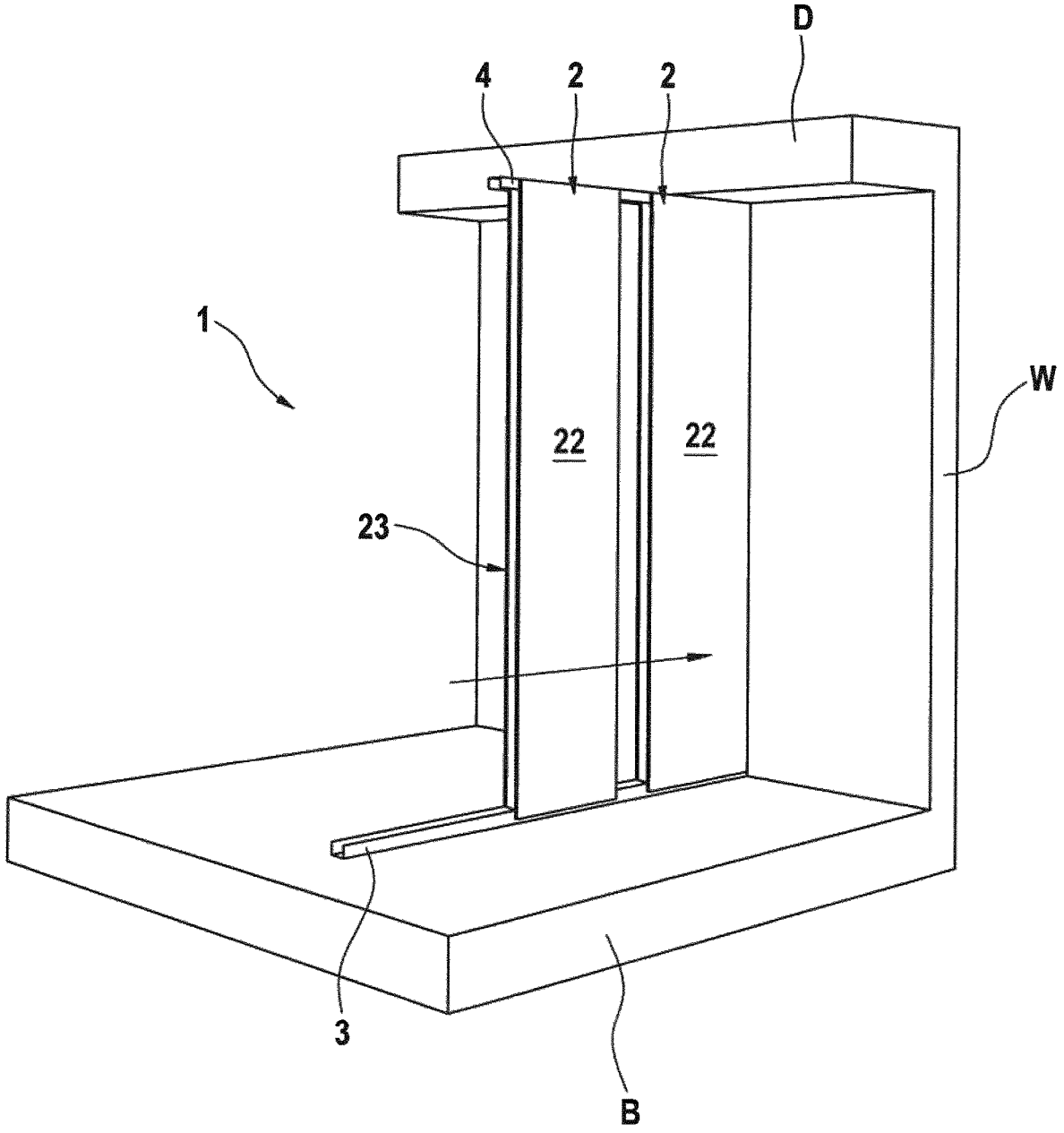

U.S. PATENT DOCUMENTS 2,063,010 A * 12/1936 Balduf ..... E04B 2/7818 52/144
2,267,477 A * 12/1941 Siebenlist ..... E04B 2/58 52/290
2,313,839 A * 3/1943 Olsen ..... E04B 2/78 52/206
2,350,093 A * 5/1944 Braloff ..... E04B 2/825 52/241
3,017,672 A * 1/1962 Vaughan ..... E04B 2/825 52/241
3,293,813 A * 12/1966 Emmons ..... E04B 2/7854 52/238.1
3,324,615 A * 6/1967 Zinn ..... E04B 2/7409 52/241
3,744,199 A * 7/1973 Navarre ..... E04B 2/78 52/481.2
3,897,668 A * 8/1975 McDonnell ..... E04B 2/822 52/632
4,263,764 A * 4/1981 Wendt ..... E04B 2/789 52/481.2
4,361,994 A * 12/1982 Carver ..... E04B 2/7455 52/238.1
4,787,767 A * 11/1988 Wendt ..... F16B 2/22 403/187
4,833,849 A * 5/1989 Williams ..... E04B 2/7453 52/281
4,854,096 A * 8/1989 Smolik ..... E04B 2/767 52/241
5,040,345 A * 8/1991 Gilmour ..... E04B 2/825 52/243.1
5,287,675 A * 2/1994 McGee ..... E04B 2/60 52/265
5,471,805 A * 12/1995 Becker ..... E04B 2/7411 52/241
5,590,505 A * 1/1997 Bogle ..... E04B 2/766 52/376
5,655,344 A * 8/1997 Moen ..... E04B 2/789 52/238.1
5,755,066 A * 5/1998 Becker ..... E04B 2/7411 52/241
5,927,038 A * 7/1999 Goldberg ..... E04B 2/821 403/109.1
5,950,386 A * 9/1999 Shipman ..... A47B 57/425 52/239
6,047,519 A * 4/2000 Bagn ..... E04B 1/10 52/656.1
7,021,021 B2 4/2006 Saldana
8,151,526 B2 * 4/2012 Klein ..... E04B 2/7411 52/232
8,181,404 B2 * 5/2012 Klein ..... E04B 2/7411 52/232
8,495,844 B1 * 7/2013 Johnson, Sr. ..... E04F 19/061 52/287.1
2003/0093969 A1 * 5/2003 Saldana ..... E04B 1/2403 52/715
2003/0115818 A1 * 6/2003 Weurman ..... E04B 2/789 52/481.2
2005/0138878 A1 * 6/2005 Becker ..... E04B 2/7457 52/506.01
2006/0000670 A1 * 1/2006 Dodd ..... E04B 2/7448 181/285
2007/0193143 A1 * 8/2007 Antonie ..... E04H 9/14 52/241
2008/0053016 A1 * 3/2008 Kang ..... E04B 2/7457 52/243.1
2011/0146180 A1 * 6/2011 Klein ..... E04B 2/7453 52/317
2014/0290175 A1 * 10/2014 Klein ..... E04B 2/767 52/653.1
2016/0208484 A1 * 7/2016 Pilz ..... E04B 2/7457
2016/0333580 A1 * 11/2016 Vehniainen ..... E04G 21/28
2016/0369500 A1 * 12/2016 Leye ..... E04B 2/7412
2017/0342736 A1 * 11/2017 Roshinsky ..... E04B 2/767
2020/0378114 A1 * 12/2020 Quirijns ..... E04B 2/828

FOREIGN PATENT DOCUMENTS

DE 3137426 A1 6/1982
DE 8712452 U1 10/1987
DE 9315375 U1 2/1994
DE 29608828 U1 9/1996
DE 19943455 A1 4/2001
FR 2679939 A1 2/1993

OTHER PUBLICATIONS

German Search Report, dated Apr. 3, 2018, Application No. 10 2017 118 005.2, 8 pages.

* cited by examiner

Fig. 6a
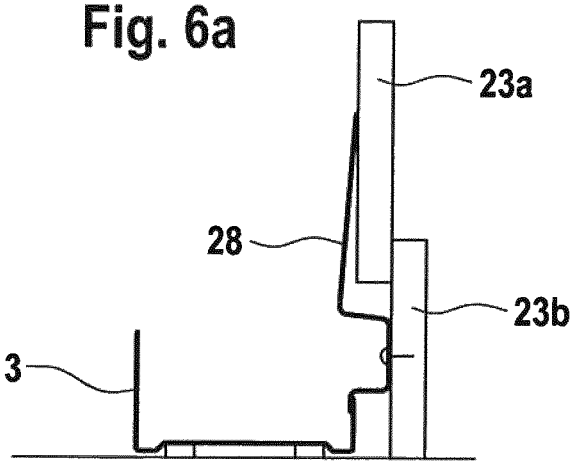
Fig. 6b
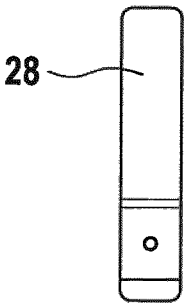
Fig. 6c
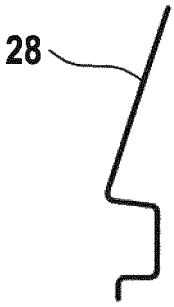
Fig. 7a
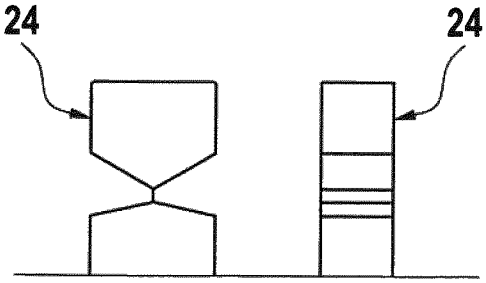
Fig. 7b
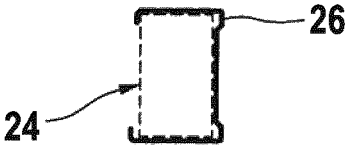
Fig. 7c
Fig. 8a
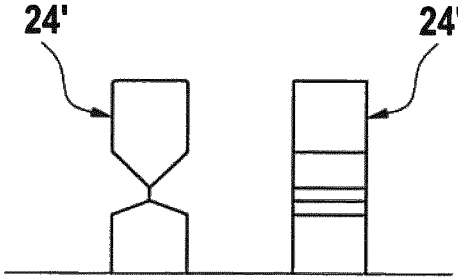
Fig. 8b
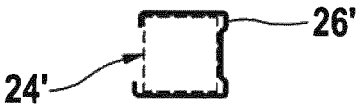
Fig. 8c

DRY PARTITION WALL SYSTEM AND METHOD FOR INSTALLATION OF A DRY PARTITION WALL SYSTEM OF THIS KIND

The invention relates to a dry partition wall system comprising a plurality of wall elements, a floor-side connection element extending over several wall elements, a ceiling-side connection element extending over several wall elements, wherein the plurality of wall elements are arranged side by side and are retained on the floor-side connection element and the ceiling-side connection element and thus jointly form a partition wall, and wherein the wall elements are of multi-layer design. The invention further relates to an installation method for a dray partition wall system of this kind.

The interior finishing of buildings such as residential houses, industrial and administration buildings, etc. has been performed increasingly in dry construction. Dry construction is used with ceiling and wall linings, and especially with light-weight partition walls. Such wall constructions have a subconstruction of wood frames or metal profiles. Dry boards are fastened thereon by means of screws or nails. Sandwich-type plasterboards, plaster wall panels, plaster fiberboards, mineral fiberboards or else wood fiberboards such as OSB, HDF, or the like are used in this process.

As a rule, such partition walls are designed as single walls and comprise a planking of the dry boards mentioned on both sides on a joint subconstruction. The planking may conventionally be single-layer or multi-layer. Usually, suitable insulating materials such as especially mineral wool are incorporated in the cavity between the plankings. The subconstruction is often manufactured of galvanized steel profiles. For ceiling and floor connections mostly UW profiles are used, while for upright elements of the subconstruction frequently CW profiles are used.

For installing a dry partition wall of this kind, conventionally first of all the subconstruction is built up at the desired site. Then, large-area dry boards are arranged thereon on one side as a planking. These dry boards usually have a width of 1.25 m, a length of 2 m to 4 m, and a thickness of 9.5 mm or 12.5 mm. After the planking has been applied on one side, the insulation is incorporated in the subconstruction. Furthermore, power supply lines, data cables, or the like are conventionally arranged in the wall structure. Subsequently, also the dry boards on the second side are screwed on. As a rule, finally the joints between the insulating boards are filled and ground, whereupon then the surface of the partition wall is finished by painting, wallpapering, or the like. The ceiling connection may be designed as a so-called sliding connection or in the standard dry construction detail as a non-sliding connection.

The advantage of a conventional dry partition wall of this kind consists in the high flexibility for adaptation to the existing space conditions. The subconstruction is always adapted individually to ceiling height, roof pitches, or the like. The same applies for the planking, wherein the boards are cut appropriately. This is absolutely of advantage when privately owned homes are constructed.

On the other hand, a disadvantage of this method of operation consists in its being very time-consuming and in requiring many personnel. In the case of larger building units such as industrial buildings, hospitals, or the like, the spaces are often predetermined in a very uniform manner by the shell of the building. The individual partition walls then often have identical dimensions, so that the flexibility is not required in the same extent during their production. Therefore, attempts were already made in the past to standardize and thus accelerate the production of such partition walls.

An example for this results from the Canadian patent application CA 2 789 905 A1 which discloses modular wall panels. They comprise frame elements on which a planking of plaster, HDF, OSB or the like is arranged. Moreover, these panels may contain an insulation of mineral wool or the like. By means of a tongue and groove system on the frame of the elements it is further possible to interconnect adjacent panels. Light switches, electric sockets, or the like may also be arranged in the panels. A lightweight board manufactured in accordance with this Canadian patent application thus comprises a plurality of panels arranged side by side and connected with each other, which may be of different design.

It is, however, a disadvantage here that the individual wall elements nevertheless have to be individually prefabricated and have to remain open on one side, at any rate temporarily, so as to apply the appropriate installations. Such panels are, in the sense of wall linings, suited to cover walls or the like. They are not provided as partition walls for rooms used on both sides.

Another example for a modular dry wall construction results from U.S. Pat. No. 3,017,672. The wall elements described in this document are formed in multiple layers of plasterboards or the like. They are placed between a floor-side connection element and a ceiling-side connection element. A wall element is placed on the floor side and then tilted to the upright position and thus positioned between the two connection elements. The wall elements contain grooves and complementary tongues at their lateral edges, so that adjacent wall elements may be coupled to each other in the kind of a groove and tongue joint. The floor-side connection element is provided as a U profile with legs of different length. A filling material is available therein. The wall element is coupled with the floor-side connection element such that it is placed in the U profile from the top. The longer leg which faces away from the side from which the wall element is tilted in, serves as an end-stop and as a guide. The ceiling-side connection element is of complementary design and comprises also a longer leg of the U profile. This leg serves as an end-stop for the wall element that has been placed. The wall elements are finally fixed by means of locking plates which are applied at the outer side of both the floor-side connection element and the opposing ceiling-side connection element and thus produce form fit for accommodating the wall element.

A disadvantage of this partition wall is i.a. the external appearance since the locking plates project at the outer side of the lower and upper sides and remain visible unless an additional covering such as wallpaper or the like is used. But also in this case there remains a step at the place of connection. Moreover, really considerable effort is necessary for applying the locking plates to the connection elements in the places in the floor region and the ceiling region which are difficult to access.

Since the wall elements in accordance with this U.S. patent document consist moreover of plasterboards or the like and do not contain any insulation, the sound and heat insulation effect of such a conventional partition wall is restricted. The connection position of the wall element at the ceiling-side connection element is a particular problem since a gap remains here due to the system. The tilting of the wall element between the two connection elements requires a certain space for movement, and due to the given effect of gravity the wall element will always rest on the floor-side connection element. The resulting gap in the upper region, however, constitutes a very considerable sound bridge.

Exactly this aspect is of substantial importance in practice since the rooms separated by the partition wall should remain as disturbance-free from each other as possible.

These known systems with prefabricated partition wall elements have therefore not become accepted in practice.

It is therefore an object of the invention to provide a dry partition wall system which is easy to install and has a good sound insulation effect along with an attractive optical appearance. Furthermore, the invention provides an improved installation method for a dry partition wall system of this kind.

This object is solved by a dry partition wall system with the features of claim 1. It is particularly characterized in that each wall element comprises a planking on both sides, preferably with an insulating layer arranged in between, that one of the plankings is of multi-part design, and that the plankings encompass the floor-side connection element and the ceiling-side connection element at the outer side.

The dry partition wall system in accordance with the invention can manage with few components and enables quick installation while being of attractive appearance. In accordance with the invention it has been found that the planking of the wall element can also be used for producing the form fit at the floor-side connection element and at the ceiling-side connection element. At the same time an at least largely plane wall face without steps and change of material will then result in this region, which improves the optical appearance distinctly.

It is of particular advantage that a planking is of multi-part design, so that a planking may be open when the wall element is erected and is subsequently completed. This planking then does not constitute an obstacle in the area of movement of the wall element during installation. This has a particularly advantageous effect on installation.

Since, moreover, the connection elements are impacted at the outer side only, an insulation without a gap may be arranged continuously in the interior, so that also in cooperation with the insulation of the wall element a gap in the wall structure can be avoided and thus altogether a distinctly improved sound and heat insulation behavior of the partition wall can be achieved.

Moreover, the individual wall elements may beneficially be prefabricated in the factory and merely have to be erected, positioned, and fixed at the building site. Thus, it is possible to produce a partition wall system in a particularly efficient manner with little personnel expenditure and at low costs.

Advantageous further developments of the dry partition wall system in accordance with the invention are the subject matter of the dependent claims 2 to 9.

Thus, each wall element may, adjacently to the floor-side connection element, comprise at least one load-bearing element positionable relative to the planking. In this manner it is achieved that the wall element fills the entire region between the floor-side and the ceiling side connection elements after the positioning. Preferably, the load-bearing element is guided displaceably in one of the vertically extending profiles which form the support framework of the wall element. This enables in advantageous manner a fixing of the support profile and hence a securing of the wall element in height by a screwing of metal-on-metal in the overlapping region of load-bearing element and support profile.

Moreover, the planking of multi-part design may comprise a main planking and a connection strip. In this manner it is possible to provide the multi-part design of the planking in a simple way, and at the same time this enables simple end installation with known means.

The connection strip is preferably fastened to a locking retainer, so that it can be installed in a simple, quick and reliable manner on the wall element.

It is of further advantage if the plankings are interconnected by means of profiles substantially over the height of the wall element, said profiles having a length which corresponds to the clear distance between the floor-side connection element and the ceiling-side connection elements minus a sliding buffer of at least 1 cm. Then, a stable framework results which facilitates the handling of the wall elements. In particular C profiles may be used here since they have high stability while having little weight.

Furthermore, the wall elements may be connected at their side edges via a tongue and groove joint. This creates a stable partition wall in which the individual wall elements support each other mutually. Moreover, a reliable and tight closure of the room can be produced by the partition wall. The sound insulation effect of the partition wall is thus further improved.

The floor-side connection element may be designed as a U-shaped profile. Preferably, the two legs are of different length, wherein the longer leg serves as an end-stop for the complete planking. Moreover, this profile may also be provided with an insulation filling, so that a heat and sound bridge can be avoided here.

Furthermore, it is of advantage if the plankings consist of at least one layer of plasterboard or plaster fiberboard. This material has proved particularly successful in dry construction since it offers, in addition to good workability, good fire protection properties as well as an advantageous undercoat for painting or the like. Especially plaster fiberboards have great strength, so that the stability of the arrangement is again substantially increased.

If the insulation layer consists of mineral wool, a non-combustible material is used. This is of substantial advantage in the case of large buildings.

In accordance with a further aspect of the present invention, a method for installing a dry partition wall system in particular in accordance with the invention is provided. The method comprises the following steps:

installing a floor-side connection element and a ceiling-side connection element, providing a plurality of prefabricated wall elements having an insulation layer and a planking on both sides, wherein the planking is of multi-part design on one side and comprises a main planking, applying the wall element at the ceiling-side connection element in the inclined state, erecting the wall element over the floor-side connection element in the course of transferring the wall element from the inclined position to an upright position, wherein the plankings of the wall element encompass the ceiling-side connection element at the outer side, and wherein the complete planking of the wall element gets into abutment on the floor-side connection element, repeating the preceding steps with at least one further wall element, and completing the main planking available at the other side by means of a connection strip, so that the plankings also encompass the floor-side connection element at the outer side.

The method according to the invention can be performed in a particularly simple and quick manner, so that a quick and cost-saving installation of the dry partition wall system with few personnel is possible. The effort for producing a dry partition wall can thus be reduced quite substantially. At the same time a partition wall having an optically attractive appearance on both sides is achieved.

The completing of the partial planking may also take place at a later time, especially after electric installations or the like have been finished, which necessitate accessibility of the wall interior.

It is further of advantage if a load-bearing element arranged positionably in each wall element is pulled out in the direction of the floor-side connection element to the end-stop position. Each wall element may comprise, adjacently to the floor-side connection element, at least one load-bearing element positionable relative to the wall element. In this way it is achieved that the wall element fills the entire region between the floor-side connection element and the ceiling-side connection element and is in tight contact especially with the latter one. Thus, a gap and an associated heat or sound bridge is avoided even more reliably. The insulating effect of the dry partition wall system in accordance with the invention is thus increased substantially. At the same time, size tolerances of the building can be compensated.

The installing of the connection strip is particularly easy to perform if it is fastened to a locking retainer and is arranged at the wall element by means of this locking retainer. The use of tools is thus reduced substantially.

Figure 2:
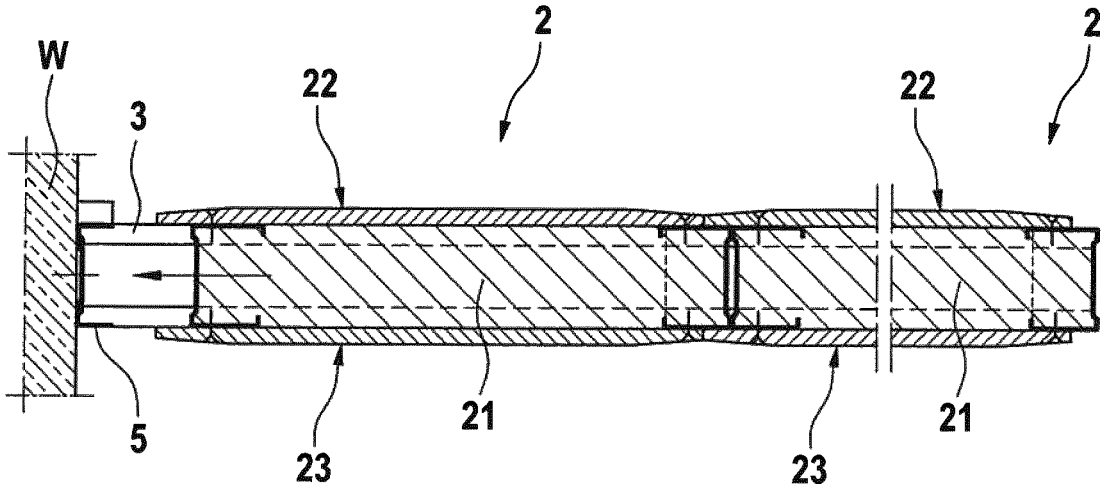
Figure 3:
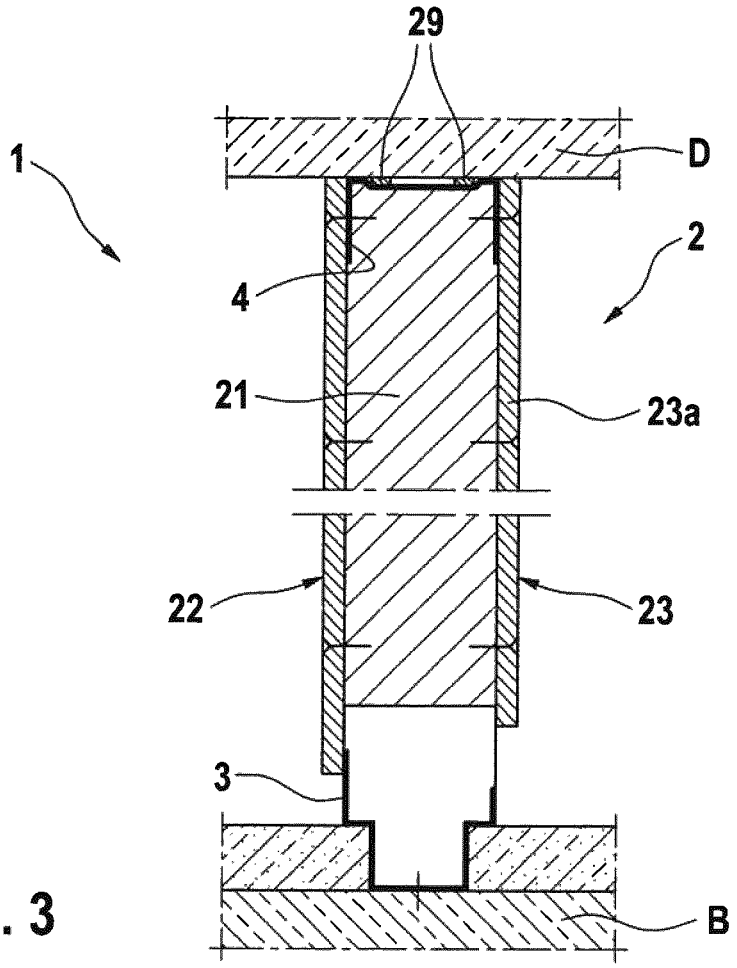
Figure 4:
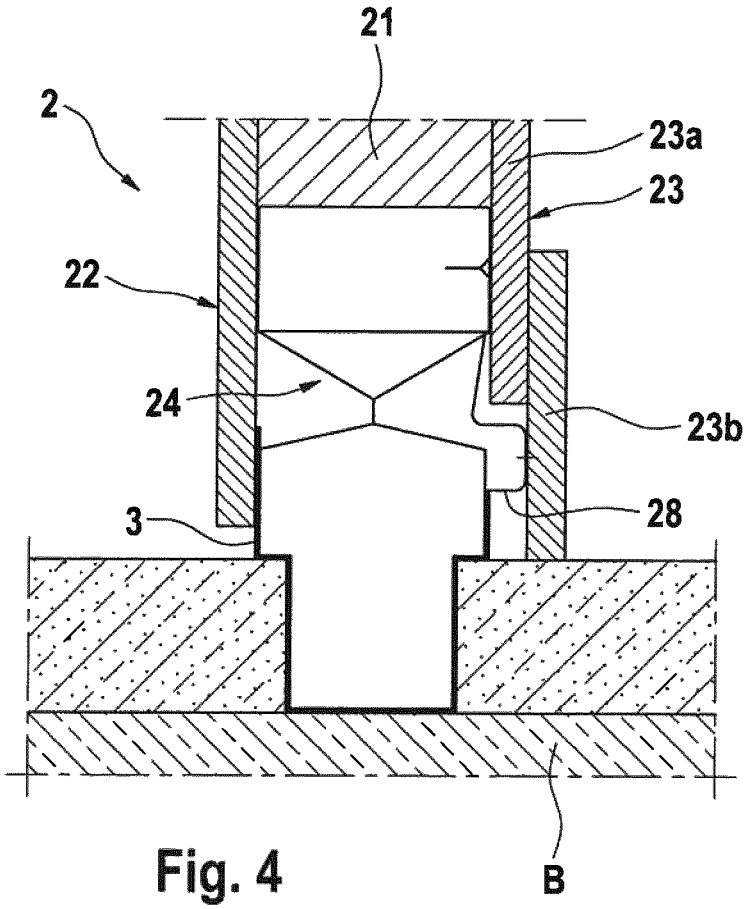
Figure 5:
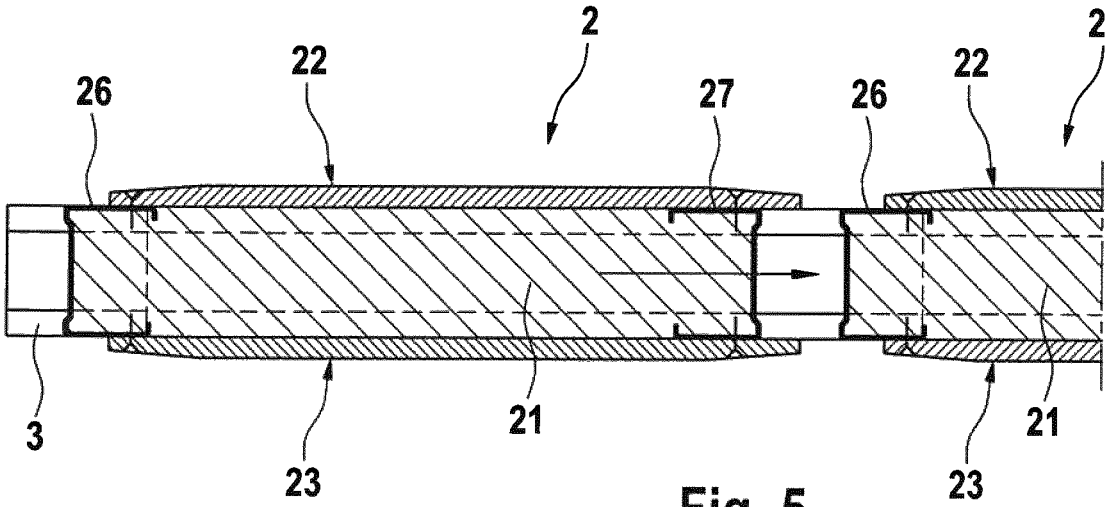

The invention will be explained in detail in the following in embodiments by means of the Figures of the drawing. There show:

FIG. 1 a perspective view of a dry partition wall system in accordance with the invention;

FIG. 2 a horizontal section through the dry partition wall system in accordance with the invention;

FIG. 3 a vertical section through the dry partition wall system in accordance with the invention;

FIG. 4 a detailed view of the floor connection;

FIG. 5 a horizontal section through two wall elements;

FIG. 6*a* a schematic detailed view of the locking retainer for the connection strip of the planking at the site of installation;

FIG. 6*b* a front view of the locking retainer pursuant to FIG. 6*a;*

FIG. 6*c* a side view of the locking retainer pursuant to FIG. 6*a;*

Figure 9:
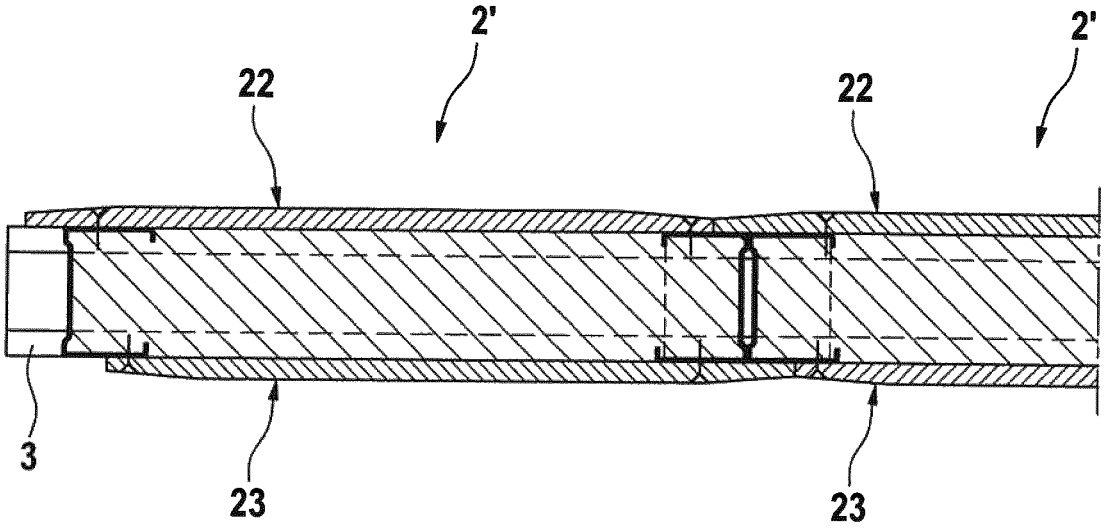
Figure 10:
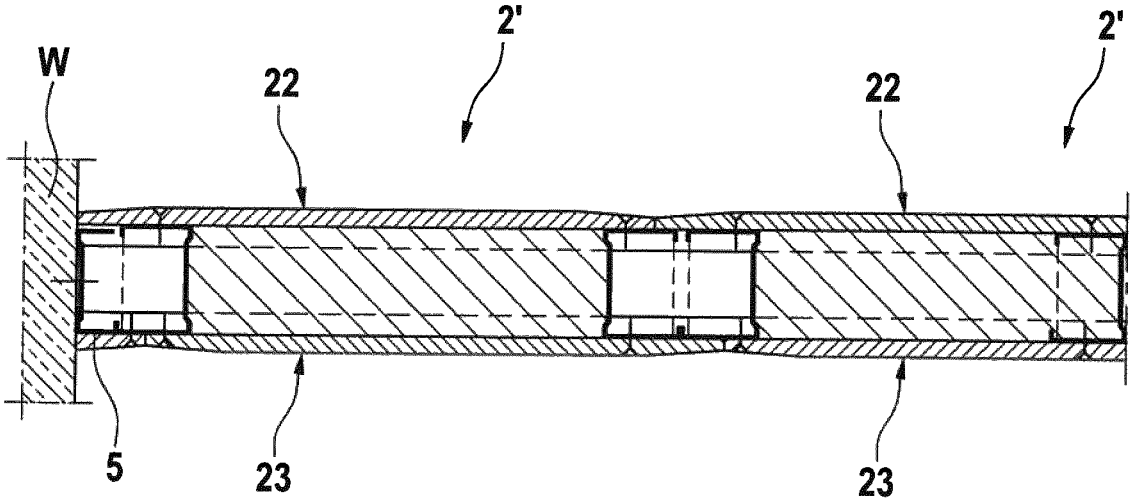

FIG. 7*a* a front view of the load-bearing element in a first embodiment;

FIG. 7*b* a side view of the load-bearing element in the first embodiment;

FIG. 7*c* a plan view of the load-bearing element in accordance with the first embodiment, as it exists schematically in an upright profile of the wall element;

FIG. 8*a* a front view of the load-bearing element in a second embodiment;

FIG. 8*b* a side view of the load-bearing element in the second embodiment;

FIG. 8*c* a plan view of the load-bearing element in accordance with the second embodiment, as it exists schematically in an upright profile of the wall element;

FIG. 9 a horizontal section of a further embodiment of a wall element in accordance with the invention; and FIG. 10 a horizontal section of the further embodiment of the wall element in accordance with the invention in the installed state.

In accordance with the illustration in FIGS. 1 to 3 a dry partition wall system 1 comprises a plurality of wall elements 2, a floor-side connection element 3, a ceiling-side connection element 4, and a wall-side connection element 5. In the illustrated embodiment two wall elements 2 are arranged side by side. Their number varies, however, in the end as a function of the length of the partition wall to be made. The dry partition wall system 1 is arranged in an installation space between a floor B, a wall W, and a ceiling D. Both the floor-side connection element 3 and the ceiling-side connection element 4 extend over several wall elements 2 and serve for orientation of the wall elements 2.

Each wall element 2 comprises an insulation layer 21 formed of mineral wool as well as a complete planking 22 on one side and a divided planking 23 on the other side. The wall element 2 is thus of multi-layer construction comprising an insulation core and plankings at the outer sides.

FIG. 3 shows details of the wall connection of the wall element 2 and/or the connections between the wall elements 2. The wall element 2 is pushed on the wall-side connection element 5 such that the connection element 5 comes to lie between the plankings 22 and 23. The space in the region of the wall-side connection element 5 is also filled with an insulation. The wall element 2 is then fastened thereto by means of drywall screws.

In accordance with the illustration in FIG. 4 the divided planking 23 is composed of a main planking 23*a* and a connection strip 23*b*. The connection strip 23*b* is first of all omitted during the installation of the wall element 2 and is finally applied to the wall element 2 for producing a form fit with the floor-side connection element 3. The mode of fastening of the connection strip 23*b* will be explained in detail later.

The wall element 2 comprises further a lower load-bearing element 24 which is displaceable and hence positionable between the plankings 22 and 23. The load-bearing element 24 has a substantially X-shaped cross-section and will be explained in detail later.

As is shown especially in FIG. 5, the wall profile 2 further comprises an outer upright edge profile 26 at one side edge face and an inner upright edge profile 27 at the other side edge face. These are of C-shaped design and formed of a metal profile with a profile width of 75 mm. The profiles 26 and 27 provide a stable framework for the wall element 2 and connect the respective plankings 22 and 23. The load bearing element 24 is further inserted in the edge profile 26 in the floor region.

The plankings 22 and 23 are formed of plasterboards, preferably in the kind of plaster fiberboards. They are in a per se conventional manner fixed to the profiles 26 and 27 by means of drywall screws.

As may additionally be taken from the horizontal section illustrated in FIG. 5, the insulation layer 21 protrudes with the outer upright edge profile 26 laterally over the plankings 22 and 23. In the other edge section the insulation layer 21, however, recedes with the inner upright edge profile 27 relative to the plankings 22 and 23 and forms a groove therewith. The wall elements 2 thus each have a protrusion and a groove at their upright longitudinal edges, so that they may be coupled reliably with adjacent wall elements in the kind of a tongue and groove joint. This produces a form-fit connection which may be secured additionally by drywall screws.

The floor-side connection element 3 is designed substantially U-shaped of a metal profile. In the instant embodiment it comprises the illustrated stepped U-shape pursuant to FIGS. 3 and 4. It may then be embedded reliably in a screed. Moreover, in the illustrated embodiment it comprises two legs of different length, the longer of them serving as an end-stop for the complete planking.

The wall-side connection element 5 is also U-shaped. The ceiling-side connection element 4 is also designed as a U-profile in this embodiment.

FIG. 3 shows the ceiling connection of the wall element 2. As may be taken therefrom, the two plankings 22 and 23 encompass the ceiling-side connection element 4 on both sides and thus produce a form fit. The wall element 2 moreover abuts on the ceiling D. The connection of the wall element 2 with the connection element 4 and/or the ceiling D is thus gap-free.

As may be seen from FIG. 4, the floor-side connection element 3 encompasses the load-bearing element 24 of the wall element 2 also in a form-fit manner. At the same time the floor-side connection element 3 serves, at the outer side at its longer leg, as an end-stop for the complete planking 22 while it is, at the other side, in engagement with a locking retainer 28 holding the connection strip 23*b*.

The locking retainer 28 is illustrated in more detail in FIGS. 6*a*, 6*b*, and 6*c*. As soon as the wall element 2 is in its intended position, the multi-part planking 23 may be completed by the connection strip 23*b*. The locking retainer 28 is firmly connected with the connection strip 23*b*. This arrangement is then inserted in the free space between the main planking 23*a*, the divided planking 23, and the floor-side connection element 3 such that a long leg of the locking retainer 28 comes to lie behind the main planking 3*a* within the wall element 2. It exerts an elastic force keeping it reliably in place. At the same time, a chamfer of the locking retainer 28 is inserted behind the shorter leg of the connection element 3 in that the locking retainer 28 is displaced downward. The connection strip 23*b* is then externally in abutment with the main planking 23*a* and produces a spatial termination. The locking connection enables advantageously a non-destructive removal of the connection strip 23*b* if necessary.

An insulation of mineral wool is further arranged in the cavity of the floor-side connection element 3.

FIGS. 7*a* to 7*c* show a load-bearing element 24 pursuant to a first embodiment. FIG. 7*a* illustrates a front view of the load-bearing element which reveals the X-shaped basic design with a profile closed in the upper half. A side view is illustrated in FIG. 7*b*. FIG. 7*c* illustrates by means of a schematic plan view of the load-bearing element 24 how it is positioned in an upright edge profile 26 (or 27). It is caught therein circumferentially, but may be displaced and/or pulled out in the longitudinal direction of the edge profile. The elements may then be fixed to one another by screws, rivets, or the like.

FIGS. 8*a* to 8*c* show a somewhat modified design of a load-bearing element 24'. It has, matching an edge profile 26', a smaller dimension in a main direction, but is irrespective thereof of functionally identical design to the load-bearing element 24 of FIGS. 7*a* to 7*c*.

The installation process of the dry partition wall system 1 will be explained in the following:

First of all the installation space for the dry partition wall system 1 is prepared. For this purpose, the floor-side connection element 3, the ceiling-side connection element, and the wall-side connection element 5 are installed on the floor B, the wall W, and the ceiling D. They are dowelled in the usual manner.

At the same time, a plurality of wall elements 2 may be preassembled in the factory and finally be provided at the building site. In this case the connection strip 23*b* of the divided planking 23 is first omitted.

In the following the steps for erecting the wall element will be illustrated. A first wall element 2 is applied in the inclined state on the ceiling-side connection element 4 and is finally pivoted there about until it is in the upright position. This step may be performed manually or with the aid of a suitable transport and positioning device such as a vacuum lifting device. The complete planking 22 gets into abutment with one side of the floor-side connection element 3. The plankings 22 and 23 of the wall element 2 encompass in this state the ceiling-side connection element 4 on the outer side with positive locking.

The wall element 2 is in this state in sliding connection with the floor-side connection element 3 and the ceiling-side connection element 4 and is displaced thereon in the direction of the wall-side connection element 5. There, it gets into engagement therewith in the manner illustrated in FIG. 2.

In a next step the wall element 2 is raised until it is in abutment with the ceiling D. A connection seal in the form of two sealing tapes 29 arranged between the ceiling-side connection element 4 and the ceiling D seals the space between these two elements. In this embodiment the sealing tapes 29 are designed as a compressible sealing tape and are fastened to the ceiling-side connection element 4 by means of gluing.

As soon as the positioning of the wall element 2 has been finished, the load-bearing element 24 is pulled out from the edge profile 26 until it supports the wall element 2 on the floor side. The X-shaped cross-section of the load-bearing elements 24 supports the pulling out thereof from the edge profile, on the one hand, and additionally stabilizes the arrangement, on the other hand. Then, the load-bearing element 24 is fixed by means of drywall screws or the like at the section of the edge profile 26 which is free at that moment. The wall element is thus retained reliably in place. Likewise, the ceiling-side connection element 4 and the wall-side connection element 5 are connected with the plankings 23 and 23 by means of drywall screws or the like.

Subsequently, a further wall element 2 is provided, applied to the ceiling-side connection element 4, and taken from the inclined position to the upright position. This wall element 2, too, is then displaced laterally in the direction of the wall element 2 that has already been installed, until it engages therein with positive locking in the manner illustrated in FIG. 3. Then, raising of the wall element 2 along with pulling out of the load-bearing elements 24 and fixing thereof takes place as described before, and fixing of the wall element at the ceiling-side connection element 4 and at the upright edge profile 26 of the other wall element 2 by means of drywall screws or the like.

This process is repeated until all wall elements 2 necessary for forming the dry partition wall system 1 have been installed. If a clearance to a further side wall remains at the edge, the missing wall piece may be manufactured manually in the usual manner if necessary.

Finally, the connection strip 23*b* is then applied to the main planking 23*a* and/or the wall element 2 and is fastened by means of the locking retainer 28 and possibly by drywall screws.

Then, the dry partition wall system 1 as such is finished.

In a concretely tested embodiment the dimension of an individual wall element was 2600×600×100 mm, wherein the edge profiles 26 and 27 had a width of 75 mm and the plankings had a thickness of 12.5 mm. The insulation material used was glass wool 60 mm with a bulk density of 16 kg/m$^3$. The area-related weight of the dry partition wall system was approx. 41.8 kg/m$^2$.

The visible surface of the plankings 22 and 23 is finally filled, ground, and provided with a top layer by painting or a wallpaper, etc. in the usual manner. Moreover, the plankings 22 and 23 may also have been provided with a bonding agent, a moisture protection, or the like in the factory. For the handling with a vacuum lifting device a coating may also be applied on at least one planking, said coating enabling the reliable maintaining of the vacuum and hence handling during installation.

In the region of the floor B a screed is applied as a rule, which is decoupled from the partition wall by means of an edge insulation strip.

In addition to the embodiments explained the invention allows for further design approaches.

In accordance with the illustration in FIGS. 9 and 10, wall elements 2' may also be designed such that the plankings 22 and 23 are laterally staggered from one another. At the connection places with the lateral wall W appropriate fitting parts may then possibly be provided for producing a complete termination.

If the connection situation especially in the floor region is solved in a different manner, the providing of a divided planking 23 may be omitted. This is, for instance, possible if the planking does not produce form fitting with the floor-side connection element 3 on one side.

For optical or other reasons the wall element may also be applied to the ceiling in a non-abutting manner for the purpose of creating a joint.

The connection strip 23*b* may also be designed such that it is flush with the main planking 23*a* in the installed state. The locking retainer 28 is then correspondingly modified, or a different kind of fastening of the connection strip 23*b* to the wall element 2 is chosen.

The lateral wall connection of the wall element 2 to the wall-side connection element 5 may be made in different ways. On the one hand, an insulation strip may be arranged in the connection element 5 in advance, said insulation strip filling the groove of the wall element 2 which is provided by the plankings 22 and 23 in cooperation with the recessed insulation layer 21, and thus avoids a gap in this place. A further possibility consists in providing the wall element in this place as a special component without a groove by a recessed insulation layer 21.

In particular application cases the sealing tapes 29 of the connection seal may also be renounced. This is especially the case when the sound insulation effect is of minor importance.

On the other hand, the connection seal may also be formed of another suitable sealing material. Basically any conventional sealing material, such as cellular rubber or the like is suited to produce the desired absence of gap. Compressible sealing bands come also into consideration. Furthermore, the cavity may be foamed.

Furthermore, it is not necessary that the plankings 22 and 23 are connected with each other via C profiles over the height of the wall element 2. Instead, U profiles or square tubes, or the like may also be used.

If the lateral wall connection of the wall element 2 can also be made in a suitable manner in a different way, it is also possible to renounce the wall-side connection element 5.

In general, it is not required, either, that metal profiles are used as a support framework of the wall elements. Basically, also components of wood, plastics, or the like may be used.

The providing of a tongue and groove joint at the side edges of the wall elements 2 is not necessary, either. In some application cases it is sufficient if the wall elements 2 are placed side by side and the joints are then filled. A design of this kind especially would have the advantage that no lateral displacement of the wall elements is required in the course of installation.

This applies equally for the fact that the wall elements would have to be screwed with one another at their side edges. This indeed increases the stability of the partition wall and avoids reliably cracks at the seams, but it may also be omitted if sufficient stability of the partition wall is also achieved without this measure.

The stepped U-shape of the floor-side connection element 3 according to the illustration in FIGS. 3 and 4 is by no means necessary. The embedding in the floor may consequently be renounced. Instead, the floor-side connection element 3 may have a conventional U-profile design and simply be placed on the floor B and be fastened there.

The floor-side connection element 3 and the wall-side connection element 5 need not be formed as a U-shaped profile, on the other hand. A C-shaped profile or the like may also be used. Moreover, no metal has to be used, but it may be sufficient to use wood, plastics, or the like where applicable. The arranging of an insulation filler in the floor-side connection element 3 and in the wall-side connection element 5 may furthermore also be renounced.

It is not necessary that the plankings 22 and 23 consist of one layer of plasterboard or plaster fiberboard. In another embodiment also two or more layers of plasterboard or plaster fiberboard may be provided.

Moreover, the plankings 22 and 23 need not be provided of plasterboard or of plaster fiber board, but may also consist of wood fiberboards, mineral fiberboards, or the like.

For the insulation layer 21 in the wall element 2 an insulation material differing from mineral wool may also be used, for instance, of an organic material such as wood soft fiber, reed, or Typha. Foamed plastics of polyethylene, polystyrene, polyurethane, or the like have proved of value in practice due to their good insulation effect. In the case of minor requirements to sound insulation the insulation layer 21 may also be omitted.

In the wall elements 2 empty tubes may also be available, or lines may be laid in the course of installation so as to provide electric power supply and/or data cables, etc. in particular positions in the room.

The invention claimed is:

1. A dry partition wall system (1) comprising:

a floor-side connection element (3) having a protruding height from a floor (B), a ceiling-side connection element (4) having a protruding height from a ceiling (D), a plurality of wall elements (2; 2'); wherein each wall element of the plurality of wall elements (2; 2') comprising a first planking (22) and a second planking (23) in parallel separated by an insulating layer (21), each of the first and second plankings (22; 23) having a thickness, a width, and a height, wherein the first plankings (22) has a larger height than the second planking (23), and wherein the height of the second planking (23) is less than a distance between a floor surface and a ceiling surface facing the floor surface minus the protruding height of the floor-side connection element (3) or the ceiling-side connection element (4), each of said plurality of wall elements (2; 2') further having a first side edge, a second side edge, a ceiling side connected to the ceiling side connection element (4), the first planking (22) coupled to a floor side connection element (3), and the second planking (23) having a connection strip (23*b*) coupled to a floor side of the second planking (23) and further coupled to the floor-side connection element (3), wherein the floor-side connection element (3) extends substantially along an overall width of said plurality of wall elements (2; 2'), and the ceiling-side connection element (4) extends substantially along the overall width of said plurality of wall elements (2; 2'), wherein said plurality of wall elements (2; 2') are arranged with the first side edge of a first wall element of the plurality of wall elements (2, 2') aligned with the second side edge of a second wall element of the plurality of wall elements (2, 2') and retained on the floor-side connection element (3) and the ceiling-side connection element (4), said plurality of wall elements (2; 2') jointly forming a partition wall.

2. The dry partition wall system of claim 1, wherein each of said plurality of wall elements (2; 2') further comprises, adjacently to said floor-side connection element (3), at least one load-bearing element (24; 24'), positionable relative to said first and second plankings (22, 23).

3. The dry partition wall system of claim 2, wherein the connection strip (23*b*) is fastened to a locking retainer (28).

4. The dry partition wall system of claim 1, wherein each of said plurality of wall elements (2; 2') comprises an insulating layer (21) in between said plankings (22, 23).

5. The dry partition wall system of claim 4, wherein the insulating layer (21) includes mineral wool.

6. The dry partition wall system of claim 1, wherein said first and second plankings (22, 23) are respectively connected by profiles (26, 27), extending over the height of said first planking (22), minus a sliding buffer.

7. The dry partition wall system of claim 6, wherein said profiles (26, 27) are C profiles.

8. The dry partition wall system of claim 1, wherein at least two of said plurality of wall elements (2; 2') are connected at side edges of said plurality of wall elements (2, 2') via a tongue and groove joint.

9. The dry partition wall system of claim 1, wherein said floor-side connection element (3) is a U-shaped profile.

10. The dry partition wall system of claim 1, wherein said first and second plankings (22, 23) include at least one layer of plasterboard or plaster fiberboard.

11. The dry partition wall system claim 1, further comprising a wall-side connection element (5) to connect a laterally outer one of the plurality of wall elements (2) with a wall (W).

* * * * *